US011577895B2

(12) United States Patent
Zacherle et al.

(10) Patent No.: US 11,577,895 B2
(45) Date of Patent: Feb. 14, 2023

(54) EXPANDABLE CARTON AND BLANK THEREFOR

(71) Applicant: WestRock Packaging Systems, LLC, Atlanta, GA (US)

(72) Inventors: Matthew E. Zacherle, Chesterfield, VA (US); Bradford Walling, Chesterfield, VA (US); Meng-Chuan Wu, Fayetteville, GA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/059,045

(22) PCT Filed: May 23, 2019

(86) PCT No.: PCT/US2019/033750

§ 371 (c)(1),
(2) Date: Nov. 25, 2020

(87) PCT Pub. No.: WO2019/226893

PCT Pub. Date: Nov. 28, 2019

(65) Prior Publication Data

US 2021/0221588 A1 Jul. 22, 2021

Related U.S. Application Data

(60) Provisional application No. 62/676,360, filed on May 25, 2018.

(51) Int. Cl.
*B65D 71/12* (2006.01)

(52) U.S. Cl.
CPC .... *B65D 71/125* (2013.01); *B65D 2571/0045* (2013.01); *B65D 2571/0066* (2013.01);
(Continued)

(58) Field of Classification Search
CPC ..... B65D 71/125; B65D 2571/00141; B65D 2571/0045; B65D 2571/00913;
(Continued)

(56) References Cited

U.S. PATENT DOCUMENTS 2,810,506 A 10/1957 Kessler
5,020,337 A * 6/1991 Krieg ..... F25D 3/06 229/103

(Continued)

FOREIGN PATENT DOCUMENTS

WO 2014/011868 A1 1/2014

OTHER PUBLICATIONS

International Search Report issued in PCT/US2019/033750, dated Jul. 15, 2019.

*Primary Examiner* — Christopher R Demeree
(74) *Attorney, Agent, or Firm* — Brian J. Goldberg

(57) ABSTRACT

Aspects of the invention relate to an expandable carton (90) which can be opened from a closed state having a first capacity, into an opened state having a second, greater capacity such that ice or other additional articles can be loaded into the expanded carton along with the original articles housed therein. The carton (90) comprises: a top wall (12), a bottom wall (16), a first side wall (14), and a second side wall (18) hingedly connected to one another to form a tubular structure. The carton (90) additionally comprises a first end wall (22*a*, 24*a*, 26*a*, 28*a*) and a second end wall (22*b*, 24*b*, 26*b*, 28*b*), each of said end walls (22*a*, 24*a*, 26*a*, 28*a*; 22*b*, 24*b*, 26*b*, 28*b*) for enclosing an open end of the tubular structure of the carton.

20 Claims, 6 Drawing Sheets

(52) U.S. Cl.
CPC ..... *B65D 2571/00141* (2013.01); *B65D 2571/00567* (2013.01); *B65D 2571/00635* (2013.01); *B65D 2571/00728* (2013.01); *B65D 2571/00913* (2013.01)

(58) Field of Classification Search
CPC .. B65D 2571/00635; B65D 2571/0066; B65D 2571/00728; B65D 2571/00567; B65D 71/36; B65D 2571/00574
USPC ..... 229/100, 101, 240, 103, 117.12, 138, 229/227, 186, 117.16; 206/427; 493/183
See application file for complete search history.

(56) References Cited

U.S. PATENT DOCUMENTS 5,303,863 A * 4/1994 Arasim ..... B65D 71/36 206/542
5,495,727 A * 3/1996 Strong ..... B65D 81/18 229/101
5,582,343 A * 12/1996 Dalvey ..... B65D 5/0005 229/101
6,631,803 B2 * 10/2003 Rhodes ..... B65D 5/542 206/427
7,611,042 B2 * 11/2009 Bates ..... B65D 5/0005 206/427
7,717,318 B2 * 5/2010 Brand ..... B65D 5/0005 229/101
7,748,603 B2 * 7/2010 Fogle ..... B65D 71/36 229/101
7,806,314 B2 * 10/2010 Sutherland ..... B65D 71/36 229/243
8,109,433 B2 * 2/2012 De Paula ..... B65D 71/36 229/101
8,136,717 B2 * 3/2012 De Paula ..... B65D 5/40 229/101
8,191,761 B2 * 6/2012 Brand ..... B65D 71/36 229/117.12
8,479,525 B2 * 7/2013 Brand ..... B65D 71/36 62/60
9,376,230 B2 * 6/2016 Kastanek ..... B65D 5/0227
9,938,035 B2 * 4/2018 Block ..... B65D 5/0227
10,246,213 B2 * 4/2019 Ayerst ..... B65D 5/10
2007/0284424 A1 12/2007 Holley
2012/0131884 A1 * 5/2012 De Paula ..... B65D 5/40 53/448

* cited by examiner

EXPANDABLE CARTON AND BLANK THEREFOR

CROSS-REFERENCE TO RELATED APPLICATIONS

This application is a U.S. National Phase Application filed under 35 U.S.C. § 371, based on International Patent Application No. PCT/US2019/033750, filed May 23, 2019, which claims priority to U.S. Provisional Patent Application No. 62/676,360, filed on May 25, 2018. The entire contents of these applications is incorporated herein by reference.

FIELD OF THE INVENTION

The present invention relates to consumer packages having an expandable structure that allows the capacity of the package to be increased. Optionally, the package initially holds and encloses a plurality of individual items, such as beverage cans, the package may be opened to expose the package contents and to expand the capacity of the structure such that additional items, for example ice can be added into the package.

BACKGROUND OF THE INVENTION

In the field of packaging it is often required to provide consumers with a package or carton comprising multiple primary product containers, for example beverage containers. Such multi-packs are desirable for shipping and distribution and for display of promotional information. It is also desirable to provide expandable cartons that can be opened up such that they then have a greater capacity and can accommodate additional items, for example ice, which can be used for cooling the beverage containers. Such an expandable carton is particularly popular during the warmer seasons for use outside, for example at picnics, barbeques and parties.

Typically, such carriers are collapsible into a flat form and are easily erected into an end-loaded structure. It is also desirable if the carton can be assembled on existing automatic machines such that no alteration, or no significant alteration, of existing automatic machines is required. For cost and environmental considerations, it is preferable if such cartons are formed from as little material as possible and cause as little wastage in the materials from which they are formed as possible. Another consideration is the strength of the packaging and its suitability for holding and transporting large weights of articles.

The present invention seeks to overcome or at least mitigate the problems of the prior art.

SUMMARY OF INVENTION

According to a first aspect of the present invention there is provided an expandable carton comprising: a top wall, a bottom wall, a first side wall, and a second side wall hingedly connected to one another to form a tubular structure. The expandable carton comprises a first end wall and a second end wall each for enclosing an open end of said tubular structure. The first end wall comprises: a composite top end closure flap, a bottom end closure flap and a pair of side end closure flaps. The composite top end closure flap is hingedly connected to said top wall. The side end closure flaps are hingedly connected to said first side wall and to said second side wall respectively. The composite top end closure flap includes a pair of expansion end sections detachably connected together along at least one severance line. The expansion end sections are further connected together by a connecting member, the connecting member being secured to respective outside surfaces of part of the expansion end sections.

Optionally, the connecting member is formed from part of the bottom end closure flap and is detachably connected to the bottom end closure flap.

Optionally, the connecting member defines a handle opening in the bottom end closure flap when detached therefrom.

Optionally, the side end closure flaps each comprise a handle reinforcing edge which is disposed in general alignment with the upper edge of the handle opening when formed in the bottom end closure flap.

Optionally, each expansion end section comprises an inner panel and an outer layer. The inner panel and outer layer of each expansion end section are hinged together, the inner panel being hinged to a respective side end closure flap, the outer layer being hinged to the top panel. The connecting member is secured to the outer surfaces of the inner panels of adjacent expansion end sections.

Optionally, a free edge of a first inner panel of adjacent expansion end sections is shaped to facilitate its folding inward ahead of the inward folding of a second inner panel of adjacent expansion end sections.

Optionally, said top wall is divisible to separate at least a first section of said top wall from a second section of said top wall. The first and second top wall sections, when separated, are movable to respective raised positions to form side extensions of said first and second side walls, and said pair of expansion end sections of said first end wall is movable to a raised position to form an end extension of said first end wall of said carton.

Optionally, the second end wall comprises: a composite top end closure flap, a bottom end closure flap and a pair of side end closure flaps. The composite top end closure flap is hingedly connected to said top wall, and said side end closure flaps are hingedly connected to said first side wall and to said second side wall respectively. The composite top end closure flap includes a pair of expansion end sections detachably connected together along at least one severance line. The expansion end sections are further connected together by a connecting member, the connecting member being secured to respective outside surfaces of part of the expansion end sections.

Optionally, said pair of expansion end sections of said second end wall is movable to a raised position to form an end extension of said second end wall of said carton.

Optionally, said at least one severance line is provided by a tear strip and wherein at least at one end of the tear strip overhangs the top wall and extends into a region between the expansion end sections of said pair to provide a tear initiator for facilitating deployment of the tear strip.

Optionally, the bottom panel comprises an aperture, which aperture becomes exposed once the tear strip has been deployed and which aperture facilitates gripping of the pair of expansion end sections.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms "carton" and "carrier" refer, for the non-limiting purpose of illustrating the various features of the invention, to a container for carrying and dispensing articles, such as product containers. It is contemplated that the teachings of the invention can be applied to various product containers, which may or may not be beverage containers and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

Figure 1:
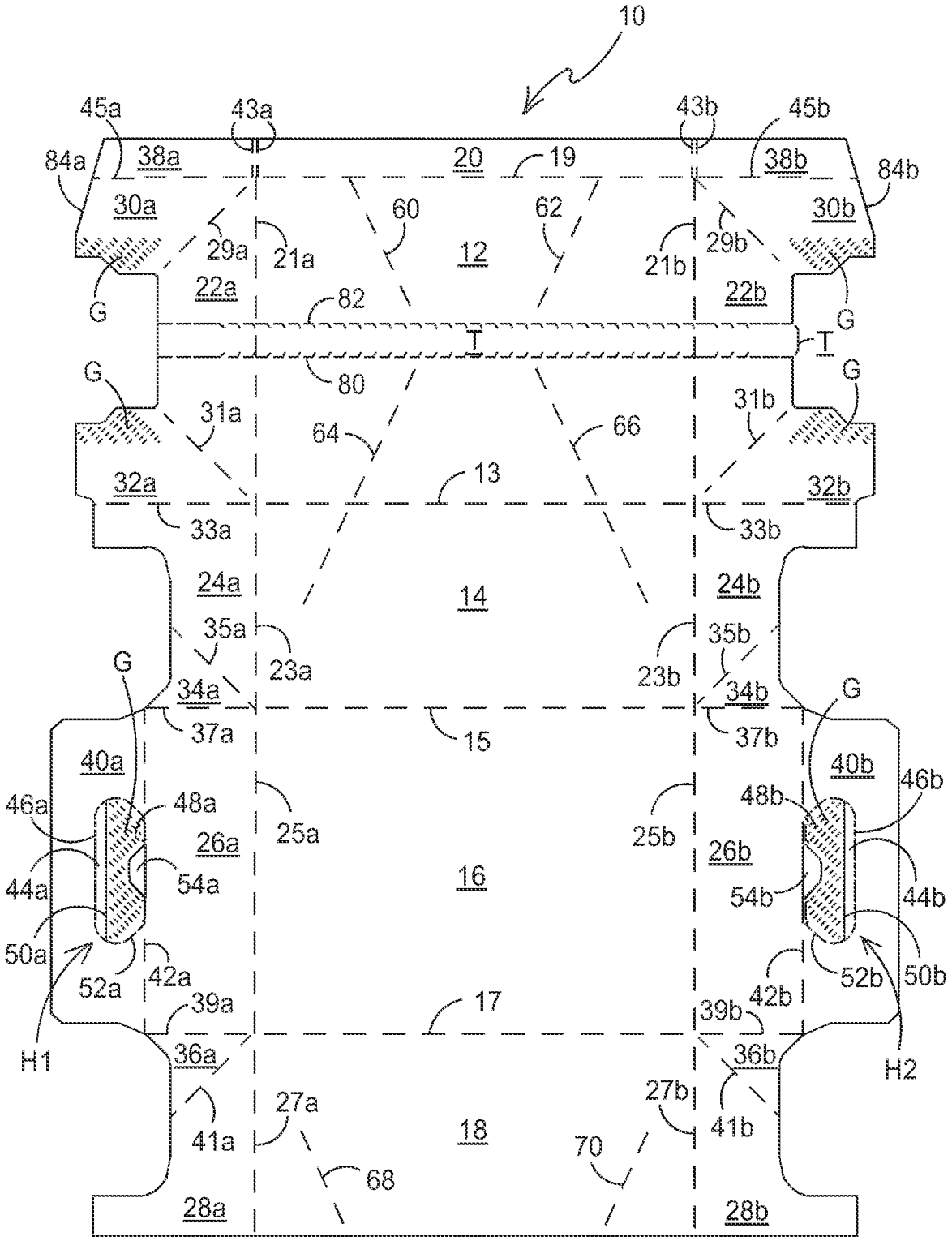
FIG. 1 is a plan view from above of a blank for forming an expandable carton according to a first embodiment of the invention.

In FIG. 1, blank 10 is illustrated with an "inside surface" facing outwards; the opposite surface of the blank 10 may be referred to as an "outer surface", "outside surface", exterior or other suitable term to distinguish from the inside surface. Optionally, the inside surface may be a non-printed side, non-bleached, non-coated, plain, brown and/or unfinished surface whereas the outside surface may be a bleached, printed, glossy, coated or otherwise treated and/or finished surface.

In the illustrated embodiment, the blank 10 is configured to form a carton 90 for packaging an exemplary arrangement of exemplary articles. In an illustrated non-limiting embodiment, the arrangement is a 3×4 matrix and the articles 'B' are cans. The blank can alternatively be configured to form a carrier for packaging other types, number and size of article and/or for packaging articles in a different arrangement or configuration.

The blank 10, as shown in FIG. 1, comprises a series of main panels hinged one to the next in series to form a tubular structure. The series of main panels includes: a top panel 12, first side panel 14, bottom panel 16, second side panel 18 and a securing panel 20. The top panel 12 is hinged along fold line 13 to first side panel 14; first side panel 14 is hinged by fold line 15 to bottom panel 16; and bottom panel 16 is hinged to second side panel 18 by fold line 17. The securing panel 20 is optionally hinged by fold line 19 to top panel 12.

The top panel 12 is provided with optional demarcation, crease or fold lines 60, 62, 64, 66, which may be contiguous with corresponding optional demarcation, crease or fold lines 68, 70, 64, 66 in the second and first side panels 18, 14. The optional fold lines may facilitate the folding of the top panel 12 once it is divided as described below. The top panel 12 also comprises at least one severance line T for dividing the top panel 12 into two sections.

At each end of each of the main panels 12, 14, 16, 18, 20 are flaps 22*a*, 24, 26*a*, 28*a*, 22*b*, 24*b*, 26*b*, 28*b* for forming end wall structures 22*a*/24*a*/26*a*/28*a*; 22*b*/24*b*/26*b*/28*b*. As viewed in FIG. 1, the left side of the blank 10 comprises: a first or top end closure flap 22*a* hinged along fold line 21*a* to a first end of top panel 12; a second or side end closure flap 24*a* hinged along fold line 23*a* to a first end of first side panel 14; a third or bottom end closure flap 26*a* hinged along fold line 25*a* to a first end of bottom panel 16; and a fourth or side end flap 28*a* hinged along fold line 27*a* to a first end of second side panel 18.

The top end closure flap 22*a* is hinged along fold line 33*a* to side end closure flap 24*a*. Side end closure flap 24*a* is hinged along fold line 37*a* to bottom end closure flap 26*a*. Bottom end closure flap 26*a* is hinged along fold line 39*a* to side end closure flap 28*a*.

Figure 3:
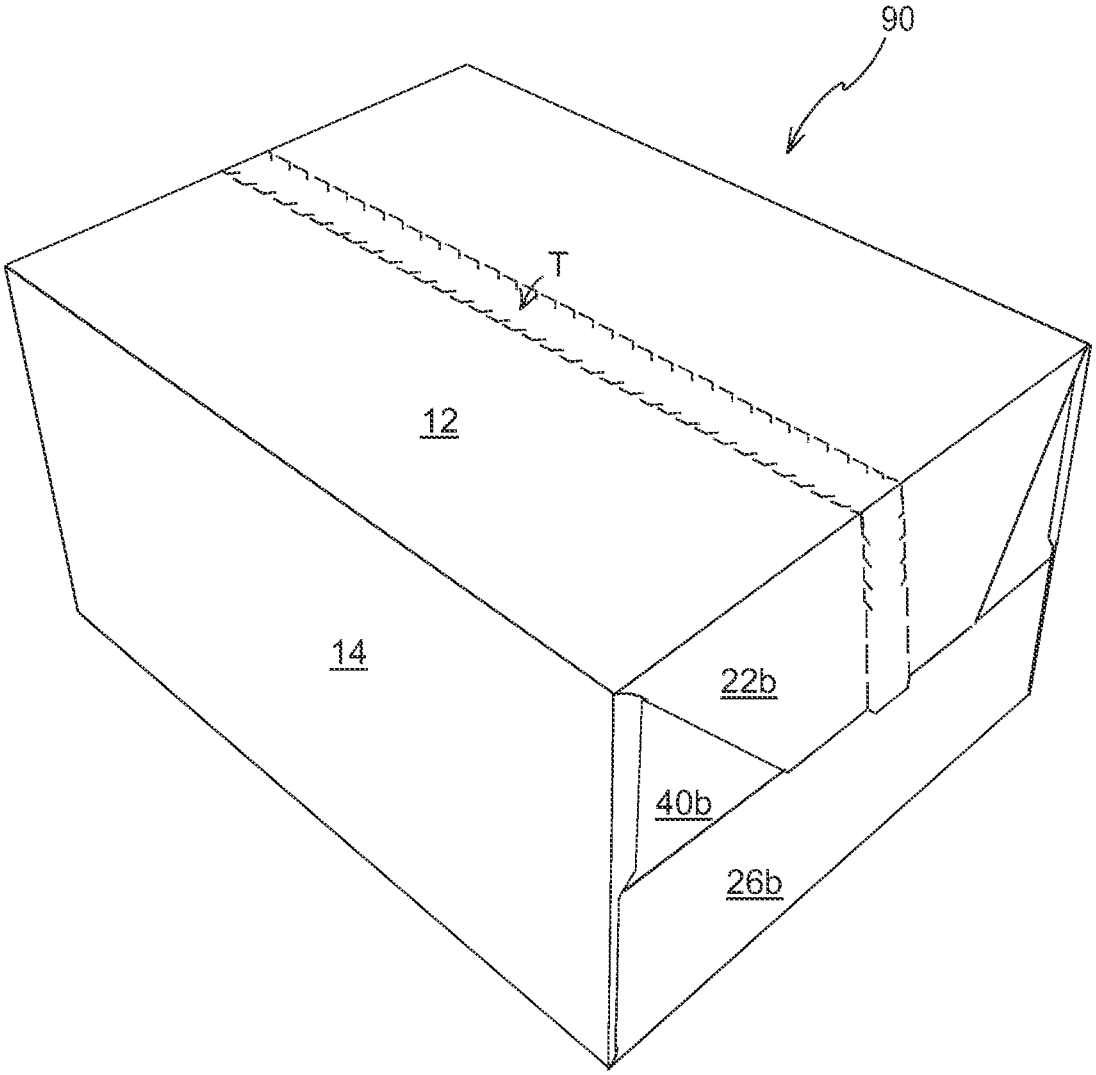
FIG. 3 is a perspective view from above of an expandable carton formed from the blank of FIG. 1, in a fully closed state.
Figure 5:
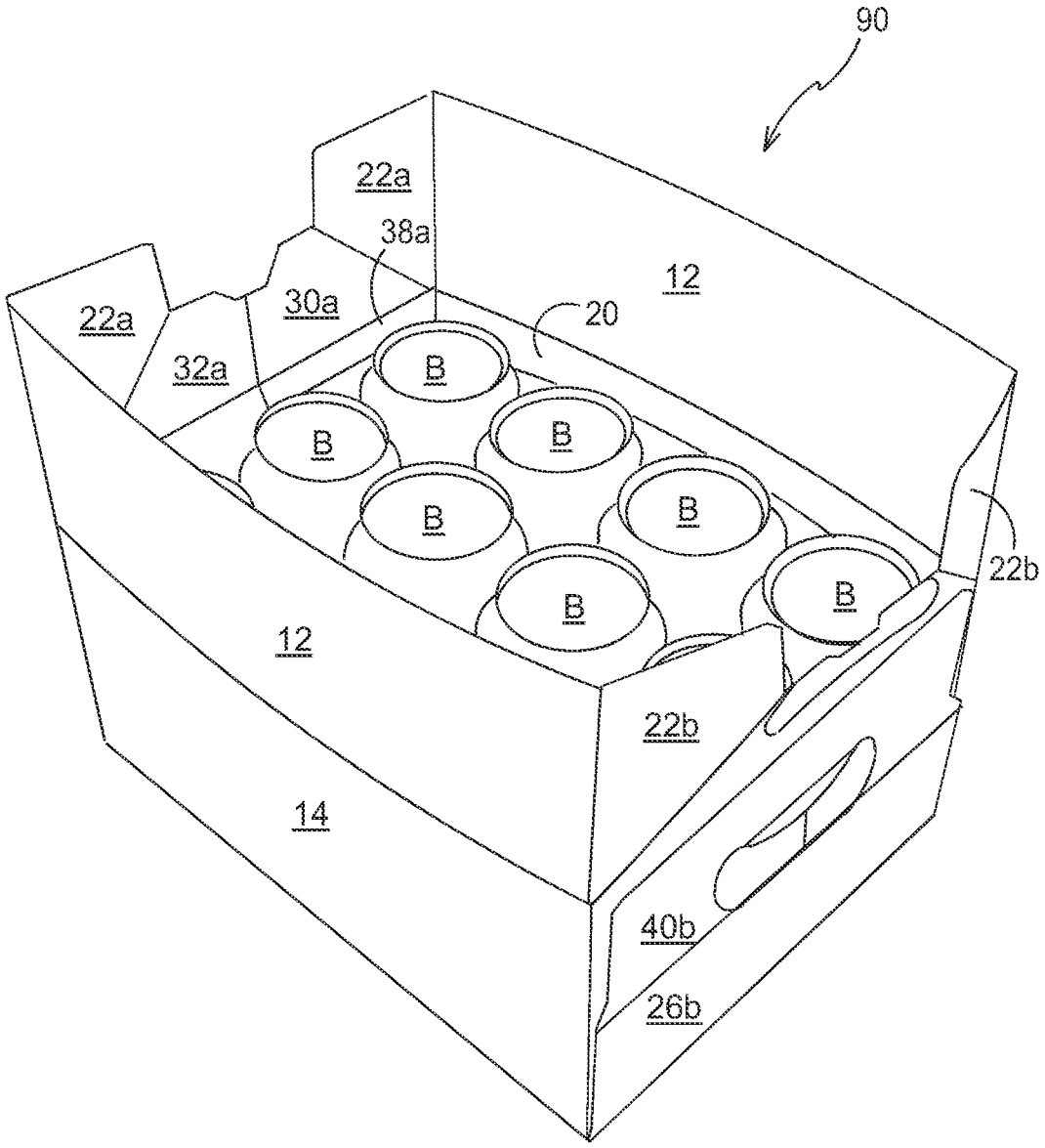
FIG. 5 is a perspective view from above of the carton of FIG. 3 now in an open and expanded state, wherein the capacity of the carton has been increased.
Figure 6:
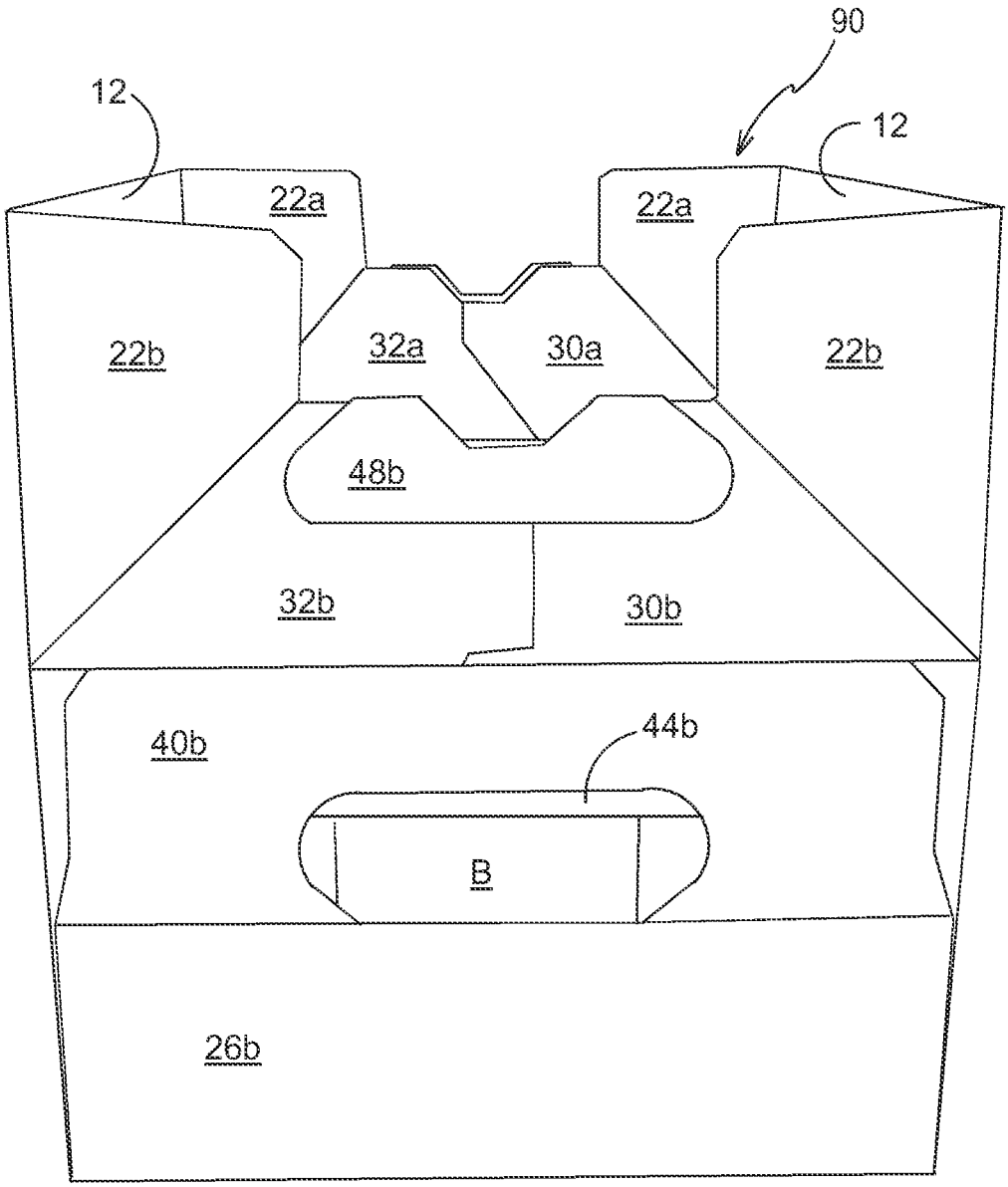
FIG. 6 is an end view of the carton of FIG. 5, showing the expanded end wall and how a handle flap is used to secure together two parts of the expanded end wall.

To enable the carton 90 as shown in FIGS. 3, 5 and 6, to be opened into an expanded carton 90 having an increased capacity, the top wall of the carton 90 (formed from the top panel 12 of blank 10) is divisible. Optionally, the top wall 12 of the carton 90 is divisible by means of at least one severance line, which optionally may take the form of a tear strip T, to separate at least a first section of said top wall 12 from a second section of said top wall 12. The first and second top wall sections, when separated, are movable to respective raised positions to form side extensions of said first and second side walls 14, 18. To allow the end wall structures 22*a*/24*a*/26*a*/28*a*; 22*b*/24*b*/26*b*/28*b* to be extended, a pair of expansion end sections 30*a*/22*a*/32*a*/22*a*; 30*b*/22*b*/32*b*/22*b* is provided in each end wall structure 22*a*/24*a*/26*a*/28*a*; 22*b*/24*b*/26*b*/28*b*.

Referring back to FIG. 1, first and second outer panels 22*a* of the top end closure flap 22*a* of blank 10 are hinged along angled fold lines 29*a* and 31*a* to inner panels 30*a* and 32*a*. Together with the respective outer panel sections of the top end closure panel 22*a*, the inner panels 30*a*, 32*a* form expansion end sections 30*a*/22*a*, 32*a*/22*a*. Together, the pair of expansion end sections 30*a*/22*a*, 32*a*/22*a* forms an end extension of the first end wall structure of the carton 90.

The bottom end flap 26*a* comprises an optional fold line 42*a*, which divides the bottom end flap 26*a* into two parts: a first lower part; and a second upper part 40*a*. The second upper part 40*a* comprises a connecting member 48*a* that is detachably connected thereto, and which is disposed in part along the fold line 42*a*. Optionally, the connecting member 48*a* is defined by lines of severance 50*a*, 52*a* and an aperture 54*a* that together may be shaped such that once the connecting member 48*a* is detached from the bottom end flap 26*a*, a handle aperture is formed (see FIGS. 5 and 6). Optionally, the bottom end flap 26*a* is provided with a cushioning flap 44*a* that is hinged to the bottom end flap 26*a* by means of a fold line 46*a*. The handle aperture and foldable cushioning flap 44*a* provide a carrying handle structure H1 for carrying the expanded carton 90.

The bottom end closure flap 26*a* also comprises an aperture 54*a* disposed along fold line 42*a*. The aperture 54*a*, once exposed assists in the gripping and unfolding of the pair of expansion end sections 30*a*/22*a*, 32*a*/22*a*.

The connecting member 48*a* is used to join together the pair of expansion end sections 30*a*/22*a*, 32*a*/22*a*, specifically the inner panels 30*a*, 32*a* thereof, such that the expansion end sections 30*a*/22*a* can be raised and provide the end extension to the first end wall structure.

An end section 38*a* of the securing flap 20 is hinged along fold line 45*a* to the inner panel 30*a* of one of the expansion end sections 30*a*/22*a*. The end section 38*a* is hinged to the securing flap 20 by means of an optional double fold line 43*a*. The end section 38*a* of the securing flap 20 is used to attach the inner panel 30*a* of one of the expansion end sections 30*a*/22*a* to the second side end closure flap 28*a*.

Turning now to the right-hand side of blank 10, it can be seen that the right-hand side of the blank 10 comprises: a fifth or top end closure flap 22*b* hinged along fold line 21*b* to a second end of top panel 12; a sixth or side end closure flap 24*b* hinged along fold line 23*b* to a second end of first side panel 14; a seventh or bottom end closure flap 26*b* hinged along fold line 25*b* to a second end of bottom panel 16; and an eighth or second side end flap 28*b* hinged along fold line 27*b* to a first end of second side panel 18.

The top end closure flap 22*b* is hinged along fold line 33*b* to side end closure flap 24*b*. Side end closure flap 24*b* is hinged along fold line 37*b* to bottom end closure flap 26*b*. Bottom end closure flap 26*b* is hinged along fold line 39*b* to second side end closure flap 28*b*.

To enable the carton 90 as shown in FIGS. 3, 5 and 6, to be opened into an expanded carton 90, the outer panels of the top end closure flap 22*b* are hinged along angled fold lines 29*b* and 31*b* to inner panels 30*b* and 32*b* which, together with respective sections of the top end closure panel 22*b*, form expansion end sections 30*b*/22*b*, 32*b*/22*b*.

The bottom end flap 26*b* comprises an optional fold line 42*b*, which divides the bottom end flap 26*b* into two parts: a first lower part; and a second upper part 40*b*. The second upper part 40*b* comprises a connecting member 48*b* that is detachably connected thereto, and which is disposed in part along the fold line 42*b*. Optionally, the connecting member 48*b* is defined by a line of severance 50*b*, 52*b* and an aperture 54*b* that together may be shaped such that once the connecting member 48*b* is detached from the bottom end flap 26*b*, a handle aperture is formed (see FIGS. 5 and 6). Optionally, the bottom end flap 26*b* is provided with a cushioning flap 44*b* that is hinged to the bottom end flap 26*b* by means of a fold line 46*b*. The handle aperture and foldable cushioning flap 44*b* provide a carrying handle structure H2 for use in carrying the expanded carton 90.

The bottom end closure flap 26*b* also comprises an aperture 54*b* disposed along fold line 42*b*. The aperture 54*b*, once exposed assists in the gripping and unfolding of the expansion end sections 30*b*/22*b*, 32*b*/22*b*.

The connecting member 48*b* is used to join together the pair of expansion end sections 30*b*/22*b*, 32*b*/22*b*, specifically the inner panels 30*b*, 32*b* thereof, such that the expansion end sections 30*b*/22*b* can be raised and provide an extension to the second end wall structure.

An end section 38*b* of the securing flap 20 is hinged along fold line 45*b* to the inner panel 30*b* of one of the expansion end sections 30*b*/22*b*. The end section 38*b* is hinged to the securing flap 20 by means of an optional double fold line 43*b*. The end section 38*b* of the securing flap 20 is used to attach the inner panel 30*b* of one of the expansion end sections 30*b*/22*b* to the second side end closure flap 28*b*.

Optionally, the side end closure flaps 24*a*, 28*a*, 24*b*, 28*b* each include a gusset panel 34*a*, 36*a*, 34*b*, 36*b*, which folds about an angled fold line, crease line or line of demarcation 35*a*, 41*a*, 35*b*, 41*b* respectively. Additionally, the side end closure flaps 24*a*, 28*a*, 24*b*, 28*b* may each comprise a handle reinforcing edge which is disposed in general alignment with the upper edge of the handle opening when formed in the bottom end closure flap 26*a*, 26*b*.

Turning now to the construction of the carton 90 from blank 10, it is envisaged that the carton 90 can be formed by a series of sequential folding operations in a straight line machine so that the carton 90 is not required to be rotated or inverted to complete its construction. The folding process is not limited to that described below or illustrated and may be altered according to particular manufacturing requirements.

Figure 4A:
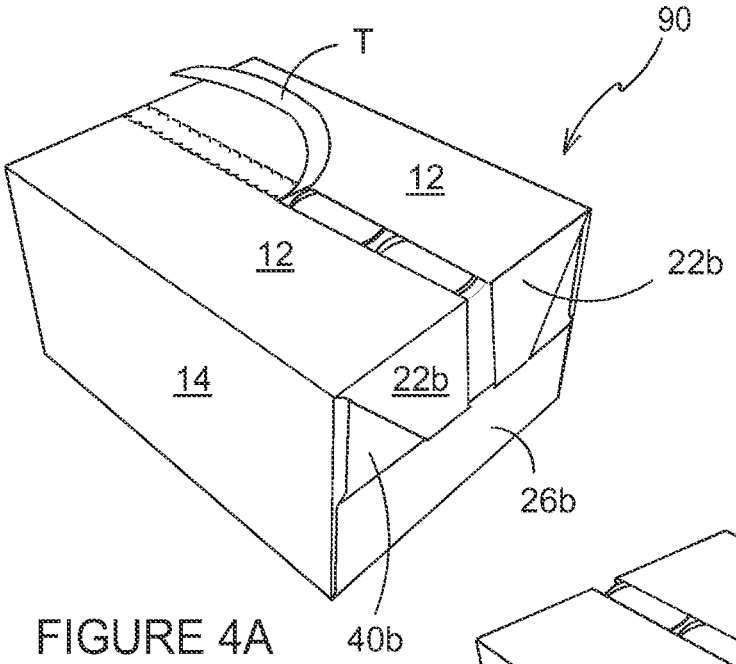
FIGS. 4A to 4C illustrate steps taken to open the carton of FIG. 3.
Figure 4B:
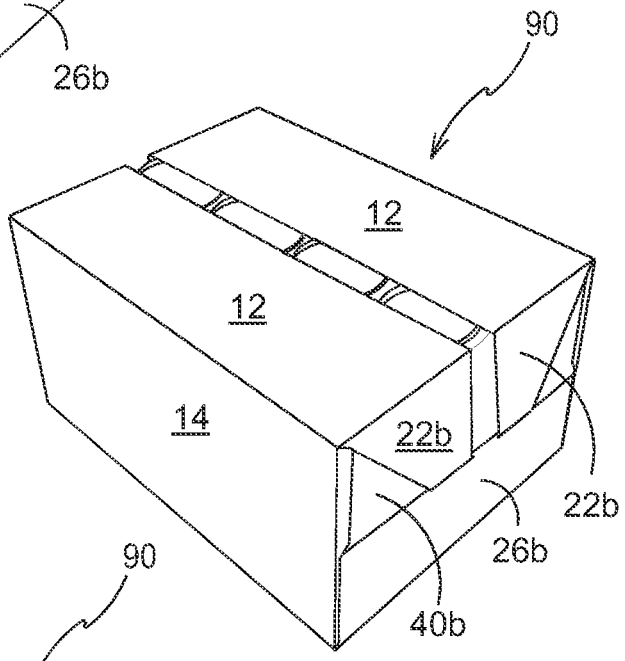
Figure 4C:
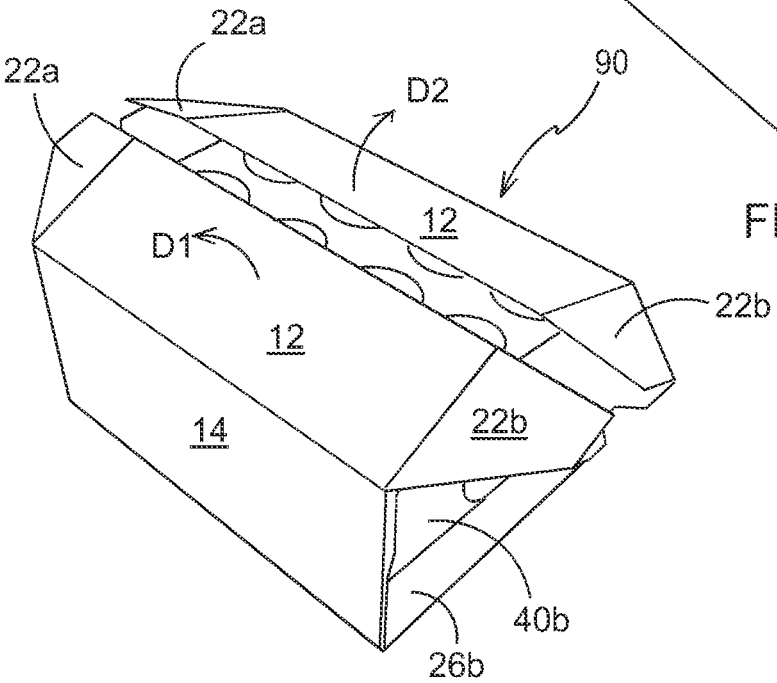

Sequential steps that may be taken to construct the carton 90 are illustrated in FIGS. 2A-2D. The fully enclosed and closed carton 90 is shown in FIG. 3. In FIGS. 4A-4C steps to open the carton 90 and expand the carton 90 are illustrated. In FIGS. 5 and 6, the expanded carton 90 is shown.

The blank 10 may be printed and coated on one surface and may be un-coated on an underside surface. To form the blank 10 into a collapsible, open ended form, the blank 10 is first folded about fold line 13 to bring the undersides of top panel 12 and securing panel 20 into face to face contacting relationship with the undersides of first side panel 14 and bottom panel 16. Fixing means, for example adhesive may be applied to the coated surface of securing panel 20; end section 38*a*; and end section 38*b*. The second side panel 18 is then folded along fold line 17, along with side end closure panels 28*a*, 28*b*, to bring the undersides of those panels 18, 28*a*, 28*b*, into face contacting relationship with the securing panel 20, end sections 38*a*, 38*b* and top panel 12. In this way, the securing panel 20 and end sections 38*a*, 38*b* adjoin the top panel 12 to second side panel 18; adjoin the inner panel 30*a* of top end closure panel 22*a* to the second side end closure panel 28*a*; and adjoin the inner panel 30*b* of top end closure panel 22*b* to the second side end closure panel 28*b*. The flat collapsed structure thereby formed can be transferred to a converting plant, whereat it may be erected into an open ended tubular structure and loaded with articles from one or both ends.

Construction of the first and second end wall structures 22*a*/24*a*/26*a*/28*a*; 22*b*/24*b*/26*b*/28*b* is preferably carried out using automatic machinery. This enables a higher throughput than hand construction. It is preferred if existing machinery can be utilized to construct the carton 90. It is therefore preferred for the bottom end closure panels 26*a*, 26*b* to be folded up before the top end closure panel is folded down as such a method may be compatible with existing machinery. It is also awkward to directly attach inner panels 30*a*/32*a*, 30*b*/32*b* of the expansion end sections 30*a*/22*a*, 32*a*/22*a*, 30*b*/22*b*, 32*b*/22*b* to one another, using for example, hot melt glue and pressure. Beneficially therefore, the present invention provides the detachable connecting members 48*a*,

48*b* to attach the inner panels 30*a*/32*a*, 30*b*/32*b* of adjacent expansion end sections to one another.

The construction of the second end wall structure 22*b*/24*b*/26*b*/28*b* is the same as the construction of the first end wall structure 22*a*/24*a*/26*a*/28*a* and therefore, the construction of only one end wall structure will be described, it being understood that the construction of the other end wall structure is the same.

Figure 2A:
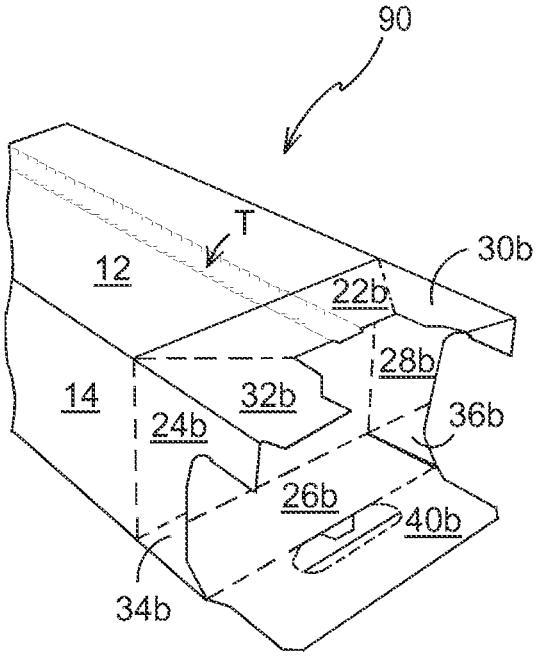
FIGS. 2A-2D are perspective views from above of a carton being formed from the blank of FIG. 1 and illustrate the assembly of an end wall of the carton.
Figure 2B:
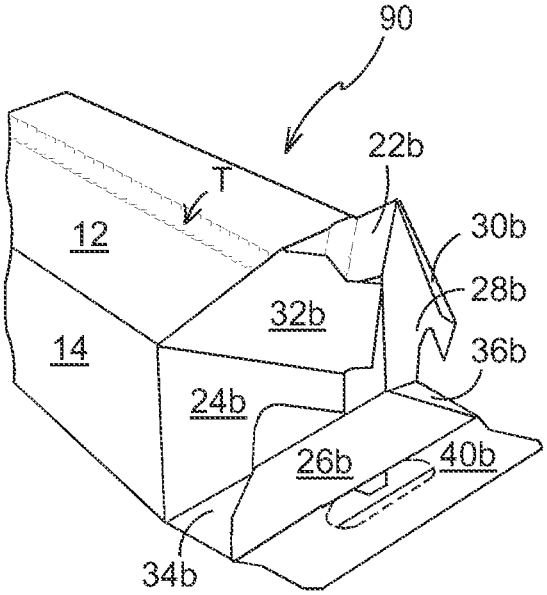
Figure 2C:
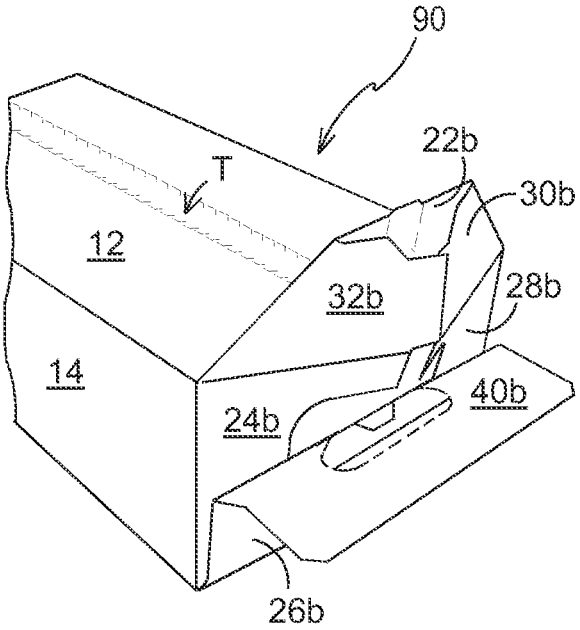
Figure 2D:
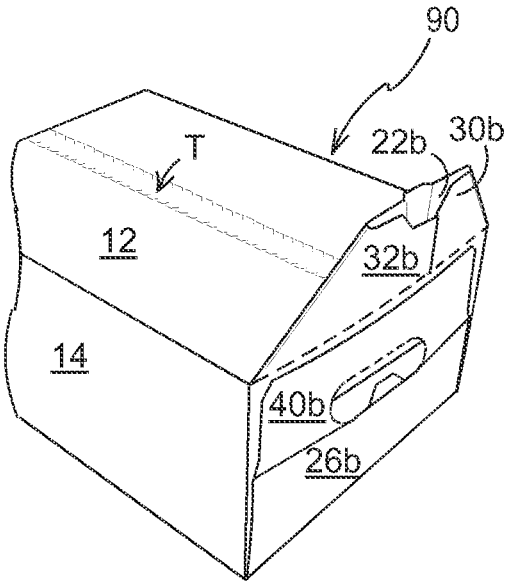

As can be seen in FIG. 2A, once the tubular structure is opened out, the end flaps 22*b*, 24*b*, 26*b*, 28*b* are held in the same plane as the main panel 12, 14, 16, 18 to which they are hinged. The side end closure panels 24*b*, 28*b* are folded inwardly about fold lines 23*b*, 27*b* respectively. This action automatically draws the inner panels 32*b*, 30*b* inwardly against the outer panels of the top end closure panel 22*b*, due to the hinged connections 33*b* 45*b*. A free edge 84*a*, 84*b* of each first inner panel 30*a*, 30*b* of adjacent expansion end sections 30*a*/22*a*; 32*a*/22*a* is shaped to facilitate its folding inward ahead of the inward folding of a second inner panel 32*a*, 32*b*. Optionally, the free edge 84*a*, 84*b* may be tapered toward the end section 38*a*, 38*b* (see FIG. 1). As is best illustrated in FIG. 2C, first inner panel 30*b* is folded flat against the outer panels of the top end closure panel 22*b* just before the second inner panel 32*b* is folded flat against the outer panels of the top end closure panel 22*b*. The folded top end closure panel 22*b*, 30*b*, 32*b* may be held in an upward position (See FIG. 2D). The provision of the gusset panels 34*b*, 36*b* may assist in drawing the bottom end closure panel 26*b*/40*b* upwardly. A guiding tool on the assembly line may be utilized to complete the upward folding of the bottom end closure panel 26*b*/40*b*. At this stage adhesive, such as a hot melt glue may be applied to the region G indicated on the connecting member 48*b* and/or may be applied to the regions G indicated on the first and second inner panels 30*b*, 32*b* (see FIG. 1). Then, the folded top end closure panel 22*b* is folded downwardly about fold line 21*b*. Pressure may be applied to ensure that the connecting member 48*b* is affixed, or otherwise secured, to the outside surface or outer surface of each of the first and second inner panels 30*b*, 32*b* to thereby attach them together.

The completed carton 90 is shown in FIG. 3. To open the carton 90, the at least one severance line T, which optionally takes the form of a tear strip T is broken. As shown in FIG. 3, the overhang of tear strip T acts as an initiator T for the tear strip T and allows a user to more easily get a grip of that end of the tear strip T for ripping it off the carton 90.

Once the tear strip T has been removed (see FIG. 4B), the aperture 54*b* allows a user to insert a finger into the carton 90 and upwardly lift the folded top end closure flap 22*b*. As the folded top end closure flap 22*b* is lifted upwardly and to some extent, unfolded, the two divided sections of the top panel 12 are automatically raised upwardly and outwardly in directions D1 and D2 respectively (see FIG. 4C). Once the folded top end closure flaps 22*a*, 22*b* are fully opened up, the carton 90 is provided with an end extension to each of the end walls and to each side wall 14, 18. As shown in FIGS. 5 and 6, the connecting members 48*a*, 48*b* are detached from the bottom end flaps 26*a*, 26*b* and are now attached, or otherwise secured, to the outside surfaces of adjacent expansion end sections 22*a*/30*a*, 22*a*/32*a*, 22*b*/30*b*, 22*b*/32*b*. In this way, adjacent expansion end sections 22*a*/30*a* and 22*a*/32*a*, 22*b*/30*b* and 22*b*/32*b* of each pair are attached together and movable together into a raised position to form sturdy end extensions to the upper section 40*a*, 40*b* of the bottom end closure panel 26*a*, 26*b*. The end extensions are best seen in FIG. 6. The carton 90, in this opened state, now has a greater capacity and can accommodate additional articles, such as ice (not shown).

It can be appreciated that various changes may be made within the scope of the present invention for example, the size and shape of the panels and apertures may be adjusted to accommodate articles of differing size or shape.

It will be recognized that as used herein, directional references such as "top", "bottom", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. An expandable carton comprising: a top wall, a bottom wall, a first side wall, and a second side wall hingedly connected to one another to form a tubular structure; and comprising a first end wall and a second end wall each for enclosing an open end of said tubular structure, the first end wall comprising: a composite top end closure flap, a bottom end closure flap and a pair of side end closure flaps, said composite top end closure flap being hingedly connected to said top wall, said side end closure flaps being hingedly connected to said first side wall and to said second side wall respectively, wherein said composite top end closure flap includes a pair of expansion end sections detachably connected together along at least one severance line, and a connecting member detachable from the bottom end closure flap and secured to respective outside surfaces of part of the expansion end sections.

2. An expandable carton according to claim 1 wherein the connecting member is formed from part of the bottom end closure flap and is detachably connected to the bottom end closure flap.

3. An expandable carton according to claim 1 wherein the connecting member defines a handle opening in the bottom end closure flap when detached therefrom.

4. An expandable carton according to claim 3 wherein the side end closure flaps each comprises a handle reinforcing edge which is disposed in general alignment with the upper edge of the handle opening when formed in the bottom end closure flap.

5. An expandable carton according claim 1, wherein each expansion end section comprises an inner panel and an outer layer, the inner panel and outer layer of each expansion end section being hinged together, the inner panel being hinged to a respective side end closure flap, the outer layer being hinged to the top panel and wherein the connecting member is secured to the outer surfaces of the inner panels of adjacent expansion end sections.

6. An expandable carton according to claim 5 wherein a free edge of a first inner panel of adjacent expansion end sections is shaped to facilitate its folding inward ahead of inward folding of a second inner panel.

7. An expandable carton according claim 1, wherein said top wall is divisible to separate at least a first section of said top wall from a second section of said top wall, said first and second top wall sections, when separated, are movable to respective raised positions to form side extensions of said first and second side walls, and each of said pair of expansion end sections of said first end wall is movable to a raised position to form an end extension of said first end wall of said carton.

8. An expandable carton according claim 1, wherein the second end wall comprises: a composite top end closure flap, a bottom end closure flap and a pair of side end closure flaps, said composite top end closure flap being hingedly connected to said top wall, said side end closure flaps being hingedly connected to said first side wall and to said second side wall respectively, wherein said composite top end closure flap includes a pair of expansion end sections detachably connected together along at least one severance line, and wherein the expansion end sections are further connected together by a connecting member, the connecting member being secured to respective outside surfaces of part of the expansion end sections.

9. An expandable carton according to claim 8 wherein each of said pair of expansion end sections of said second end wall is movable to a raised position to form an end extension of said second end wall of said carton.

10. An expandable carton according to claim 1, wherein said at least one severance line is provided by a tear strip and wherein at least at one end of the tear strip, the tear strip overhangs the top wall and extends into a region between the pair of expansion end sections to provide a tear initiator for facilitating deployment of the tear strip.

11. An expandable carton according to claim 10 wherein the bottom end closure flap comprises an aperture, which aperture becomes exposed once the tear strip has been deployed at least to some extent, and which aperture facilitates gripping of the pair of expansion end sections.

12. A blank for forming the expandable carton of any preceding claim.

13. An expandable carton according to claim 1, wherein the expansion end sections each comprise an outer panel and an inner panel, and wherein the connecting member connects together the inner panels of the expansion end sections.

14. An expandable carton according to claim 13, wherein each outer panel has at least two free end edges.

15. An expandable carton according to claim 1, further comprising a carrying handle structure formed in the bottom end closure flap, wherein at least a portion of the carrying handle structure is hingedly connected to the bottom end closure flap.

16. An expandable carton according to claim 15, wherein the connecting member is disposed within the carrying handle structure.

17. An expandable carton according to claim 16, wherein the carrying handle structure comprises a handle aperture formed at least in part by detachment of the connecting member from the bottom end closure flap, such that the connecting member is shaped to create and correspond to at least a portion of the handle aperture.

18. An expandable carton comprising: a top wall, a bottom wall, a first side wall, and a second side wall hingedly connected to one another to form a tubular structure; and comprising a first end wall and a second end wall each for enclosing an open end of said tubular structure, the first end wall comprising: a composite top end closure flap, a bottom end closure flap and a pair of side end closure flaps, said composite top end closure flap being hingedly connected to said top wall, said side end closure flaps being hingedly connected to said first side wall and to said second side wall respectively, wherein said composite top end closure flap includes a pair of expansion and sections detachably connected together along at least one severance line, wherein the expansion end sections are further connected together by a connecting member, the connecting member being secured to respective outside surfaces of part of the expansion end sections, and wherein the connecting member is defined by more than one line of severance to be detachable from the bottom end closure flap.

19. An expandable carton according to claim 18, wherein the connecting member is further defined by an aperture that, together with lines of severance, forms a shape such that detachment of the connecting member from the bottom end closure flap creates a handle aperture for a carrying handle structure.

20. An expandable carton according to claim 19, further comprising a cushioning flap hinged to the bottom end closure flap, wherein the carrying handle structure comprises the handle aperture and the cushioning flap for carrying the expandable carton in its expanded state.

* * * * *